US007156332B2

(12) United States Patent
Rees

(10) Patent No.: US 7,156,332 B2
(45) Date of Patent: Jan. 2, 2007

(54) PRODUCT CONTAINMENT APPARATUS

(75) Inventor: Mark Rees, Schaumburg, IL (US)

(73) Assignee: The Fitzpatrick Company, Elmhurst, IL (US)

( * ) Notice: Subject to any disclaimer, the term of this patent is extended or adjusted under 35 U.S.C. 154(b) by 29 days.

(21) Appl. No.: 10/848,530

(22) Filed: May 17, 2004
(Under 37 CFR 1.47)

(65) Prior Publication Data

US 2005/0139703 A1 Jun. 30, 2005

Related U.S. Application Data

(60) Provisional application No. 60/471,118, filed on May 16, 2003.

(51) Int. Cl.
*B02C 19/12* (2006.01)

(52) U.S. Cl. ..... 241/79; 209/380; 241/101.2

(58) Field of Classification Search ..... 241/101.2, 241/79; 209/379, 380; 55/294, 302, 303
See application file for complete search history.

(56) References Cited

U.S. PATENT DOCUMENTS

| | | | | |
|---|---|---|---|---|
| 2,990,238 | A | 6/1961 | Kabisch et al. | 423/590 |
| 3,169,038 | A | 2/1965 | Pendleton | 406/172 |
| 3,811,248 | A | 5/1974 | Lesk et al. | 96/424 |
| 5,030,259 | A | 7/1991 | Bryant et al. | 55/302 |
| 5,199,965 | A | 4/1993 | van Ackeren | 55/293 |
| 5,217,509 | A | 6/1993 | Jansen | 95/279 |
| 5,915,439 | A | 6/1999 | Zaiser | 15/304 |

*Primary Examiner*—Mark Rosenbaum
(74) *Attorney, Agent, or Firm*—McDonnell Boehnen Hulbert & Berghoff LLP

(57) ABSTRACT

Self contained filter backpurge systems useful for totally enclosed processing mills and for clean in place (CIP) processing material processing mills.

19 Claims, 4 Drawing Sheets

PRODUCT CONTAINMENT APPARATUS

This system claims priority to provisional patent application No. 60/471,118 filed on May 16, 2003.

BACKGROUND OF THE INVENTION

1. Field of the Invention

This invention is directed to self contained backpurge systems for material processing mills as wells methods for using such backpurge systems. In addition, this invention encompasses self contained backpurge systems useful for totally enclosed processing mills and for clean in place (CIP) processing material processing mills.

2. Description of the Art

When processing powders it is desirable to completely contain the powders inside the process housing. Therefore it is beneficial to create a process housing which is totally enclosed and impervious to air and the powder which is being processed.

In the case of a milling device with a rotating impeller assembly, the totally enclosed process housing includes the container which holds the feed material, feed device, mill chamber, including the rotary rotating impeller assembly, and the container which holds the material which is discharged from the mill chamber.

There are several problems with creating totally enclosed process housing. The first problem is that it is difficult to seal all of the various mechanical connections, which are assembled in order to create the totally enclosed process housing, and therefore the housing is subject to leaking. The second problem is that the rotating impeller assembly acts as a fan and tends to blow the product and any gas in the process area down into the discharge container. If the process does not include a way to vent gas from the discharge containers, the gas pressure tends to build up in the discharge container. This can cause material to be held up in the milling chamber. Material held up in the milling chamber is subject to the rotating impeller for longer periods of time and the particle distribution created in the milling may change from the desired particle distribution. It is also possible that material held up in the milling chamber will cause blinding of the classifying screen and cause the further process problem effectively stopping the milling process. A positive pressure in the milling chamber increases the possibility that dust can escape through a connection that is not perfectly sealed.

A further desired (optional) feature of a milling process is to operate in an inert atmosphere. This is typically done by injecting nitrogen gas along with the feed material. Therefore this nitrogen gas and any existing gas in the process area must be vented from the process area.

In order to avoid the above stated problems, current systems vent process gas and nitrogen from the discharge of the mill. The current system uses a set of filter bags in discharge housing. A vacuum system is used to draw out the process gas through the filter bags. The objective of the vacuum system is to create a slight vacuum in the discharge of the milling chamber, which has the desired effect of keeping the product in the mill chamber. The filter bags can be blinded by the dust and lose their effectiveness to draw air, nitrogen, or process gas through the filters. When the filters because blinded, existing systems use a backpurge to alternatively clean the filters. The back-purging uses compressed air or compressed nitrogen and subsequently adds additional process gas to the milling system.

This additional process gas must be removed and often the vacuum system must be increased to remove the additional gas used to clean the filters. Increasing the vacuum causes more dust to adhere to the filters and requires more frequent or stronger backpurge with the additional gas. This system can become unstable and reach a point where a vacuum cannot be held in the milling enclosure and this makes it subject to powders leaking to the outside (particularly hazardous powder).

SUMMARY OF THE INVENTIONS

A backpurge system comprising: a backpurge chamber including a plurality of walls forming an enclosure having an inlet and an outlet; an opening in at least one wall of the backpurge chamber; a filter housing associated with the opening in the at least one wall of the backpurge chamber; a filter located in the opening; a conduit having a first end associated with the filter housing and a second end associated with a vacuum source; and a backpurge piston associated with the filter housing.

A material processing mill comprising a feed section having an outlet; a mill chamber having an inlet associated with the feed section outlet and an outlet; a backpurge chamber having an inlet associated with the mill chamber outlet, an outlet, and a plurality of walls, the backpurge chamber further comprising an opening in at least one wall of the backpurge chamber; a filter housing associated with the at least one wall opening; a filter located in the at least one wall opening; a conduit having a first end associated wit the filter housing and a second end associated with a vacuum source; a backpurge piston associated with the filter housing; and a product container associated with the backpurge chamber outlet.

DESCRIPTION OF CURRENT EMBODIMENTS

The present invention relates to backpurge systems for material processing mills that quickly clean process filters without the use of external process gases. This invention further includes processing mills that includes backpurge system embodiments of this invention.

In one aspect, this invention is includes backpurge systems that draw process gases from inside the process area and that use process gases to backpurge process filters. In this respect no additional process gas is added to the system. The systems of this invention are reliable, do not alter the milling process parameters or product quality, and allow for more frequent backpurge cycles—as necessary—to keep the filters clean. Because no external gas is used to backpurge the filters in the apparatuses and methods of this invention, less process gas exists in the system so smaller filters can be used. Smaller filters are an advantage because they can be simpler in design (flat as opposed to sewn bag type). This makes the filters less costly and therefore disposable after use.

Figure 1:
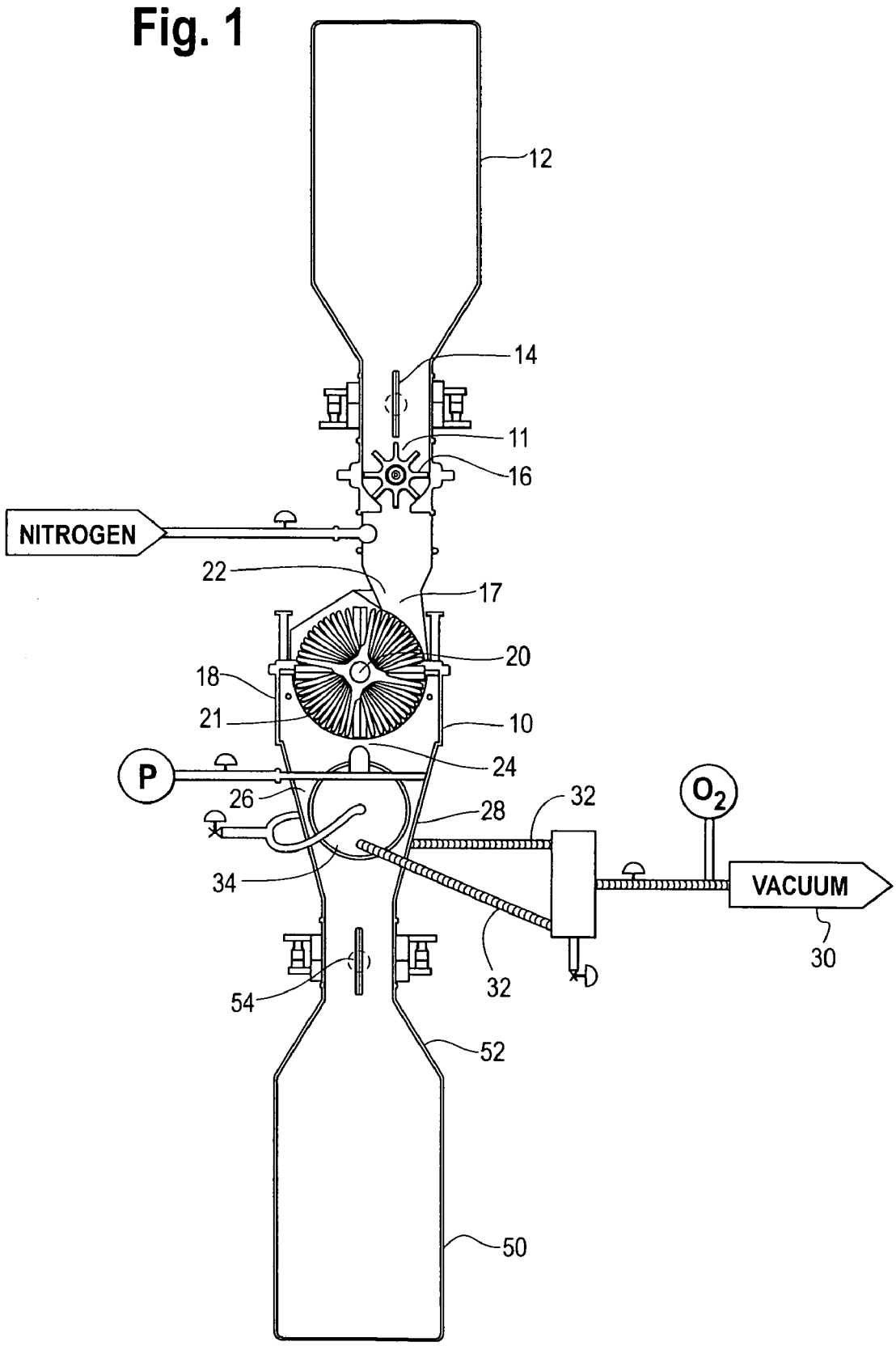
FIG. 1 is cross section view of a totally enclosed material processing mill that includes a self contained backpurge apparatus.

FIG. 1 is a side view of a processing mill of this invention including a backpurge system. FIG. 1 shows an enclosed milling device 10 including a backpurge chamber 28. Milling device 10 further includes a feed section 11 including feed hopper 12, butterfly valve 14 and metering valve 16. Feed section 11 directs a powder, particulate or solid feed into mill chamber 17 which includes an impeller chamber 18 in which a solid feed material is directed through inlet 22 and into contact with impeller 20. Impeller 20 directs the feed material against screen 21 in order to reduce the feed particle size. The reduced size product passes through holes in screen 21, through outlet 24 of mill chamber 17 and into discharge chamber 26.

Discharge chamber 26 includes backpurge chamber 28. Backpurge chamber 28 includes one or more filters 34. Backpurge chamber 28 further includes a plurality of walls 25 forming an enclosure having an inlet 27 and an outlet 29. At least one of the walls forming backpurge chamber 28 includes an opening 31. Filter 34 is located in backpurge chamber 28 such that it fills and covers opening 31. Moreover a filter housing 33 is associated with each opening so that gases may pass through filters 34 at a fairly uniform rate across the filter surface area. A vacuum source 30 including vacuum conduit 32 is associated with filter housing of backpurge chamber 28 in order to maintain a negative differential pressure across filters 34 during normal material proceeding. After passing through backpurge chamber 28, the product passes through an optional rotary or a metering valve 54 into a discharge product container 50, which in the case of FIG. 1 is a continuous liner 52 container. More detailed view of backpurge chamber embodiments of this invention are found in FIGS. 2 and 3.

Figure 2A:
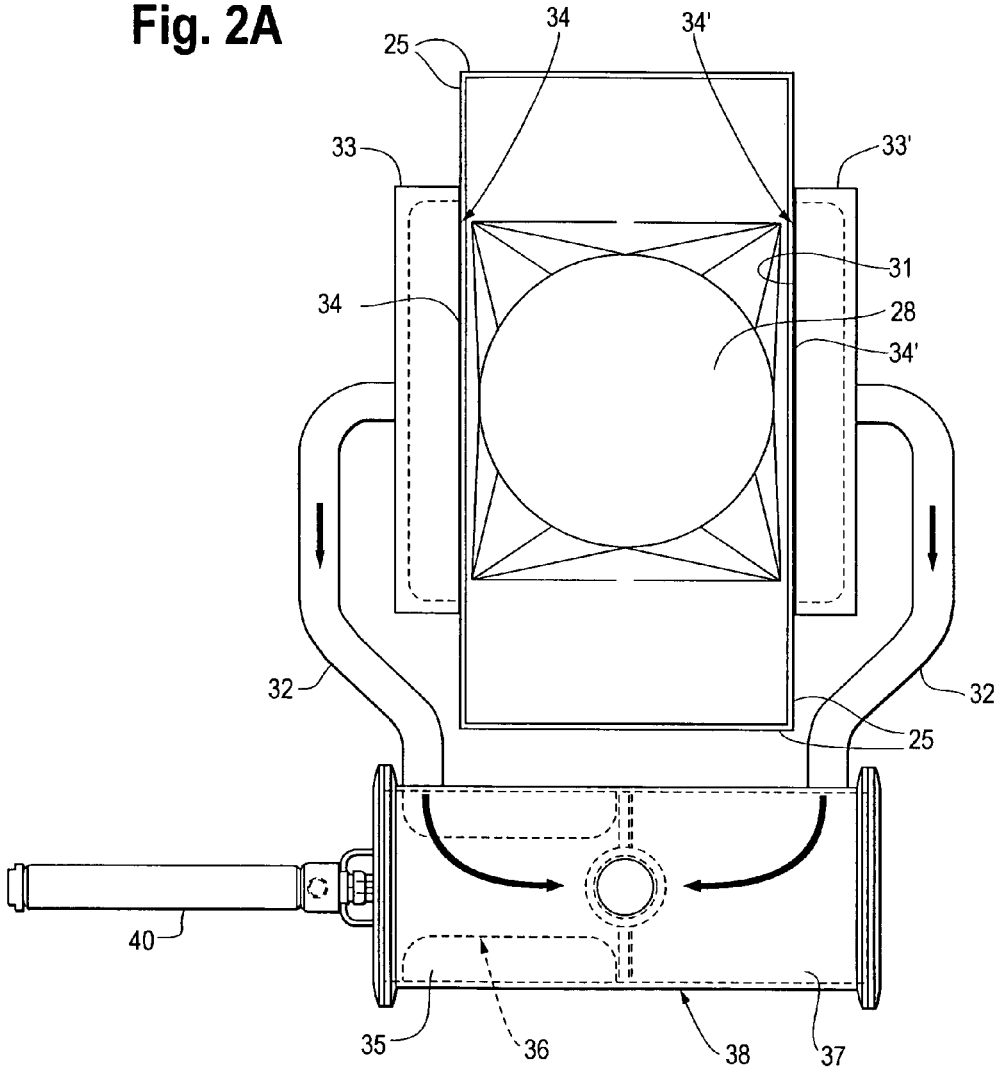
FIGS. 2A and 2B are top and side views of a self-contained backpurge system embodiment of this invention.
Figure 2B:
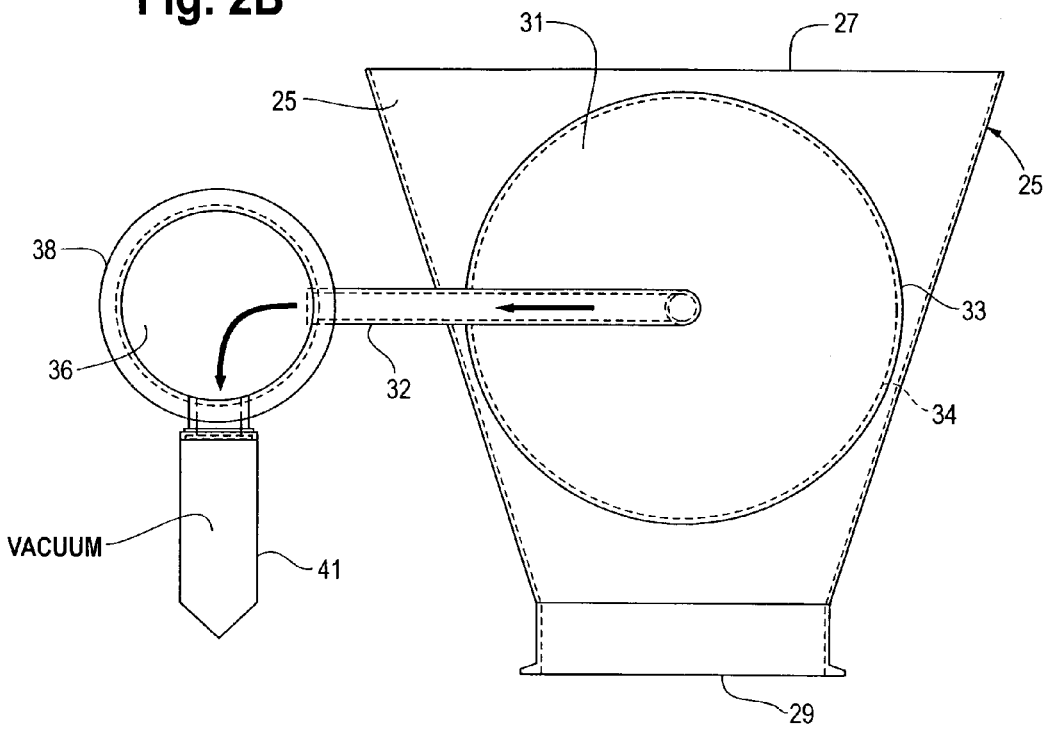

One embodiment of a backpurge system embodiment of this invention is shown in FIGS. 2A and 2B. The backpurge system embodiment of FIGS. 2A and 2B include a spool piece 36 in a spool chamber 38. Spool chamber 38 is associated with vacuum conduit 32 such that a vacuum pump (not shown) withdraws air from backpurge chamber 28 through vacuum conduit 32 and thereafter through backpurge chamber 28. In the embodiment shown in the Figures, conduit 32 is associated with each filter housing 33 in order to pull gases in a uniform rate through one or more filters 34. In an alternative embodiment, a vacuum pump may be directly associated with vacuum conduits 32 and may bypass spool chamber 38. In this embodiment, spool chamber 38 would include conduits that link spool chamber 38 directly to each filter housing 33 or to vacuum conduit 32.

According to the invention embodiments shown in FIGS. 2A and 2B, in order to backpurge one or more filters 34, spool piece 36 is shifted, like a piston, manually or with a pneumatic cylinder 40 from a first side 35 of spool chamber 38 to the opposite second side 37 of spool chamber 38 in order to force pressurized process gas created by the movement of spool piece 36 through spool chamber 38, through the appropriate conduit 32 and back through the second filter 34. The first filter 34' is purged by moving spool piece 36 from second side 37 to first side 35 of chamber 38. The movement of spool piece 36 in spool chamber 38 causes pressurized gases to flow from chamber 38 into filter housing 33, through filter 34' and into backpurge chamber 28. This sudden movement of pressurized gases causes any material fines that might be plugging filters 34 or 34' to be expelled from filter 34 or 34' into backpurge chamber 28 thereby improving the efficiency of the filter(s) during normal process operations. While spool 39 is moving, it is preferred that outlet 41 to the vacuum system is blocked.

Figure 3A:
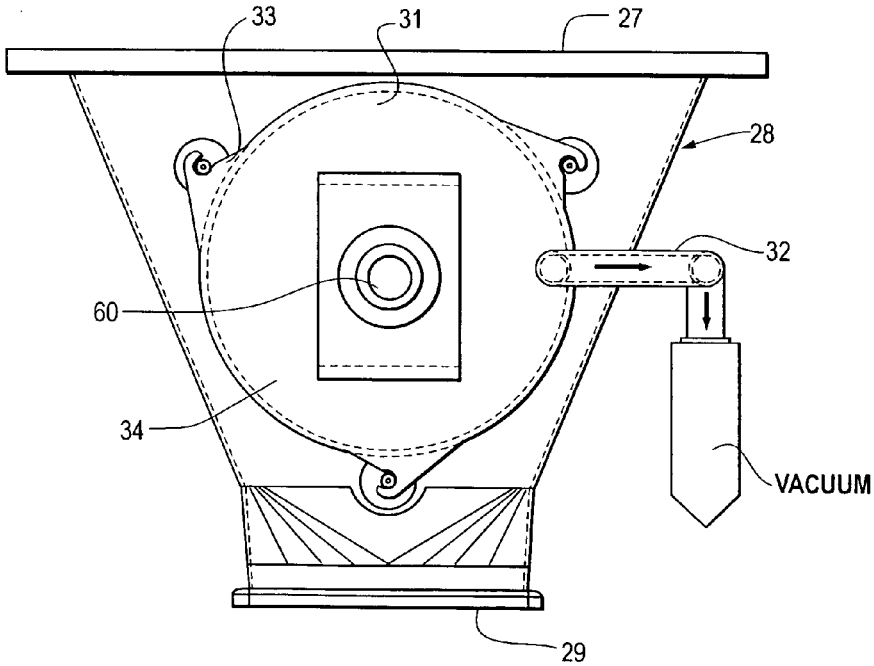
FIGS. 3A and 3B are side and top views of an alternative self-contained backpurge system embodiment of this invention.
Figure 3B:
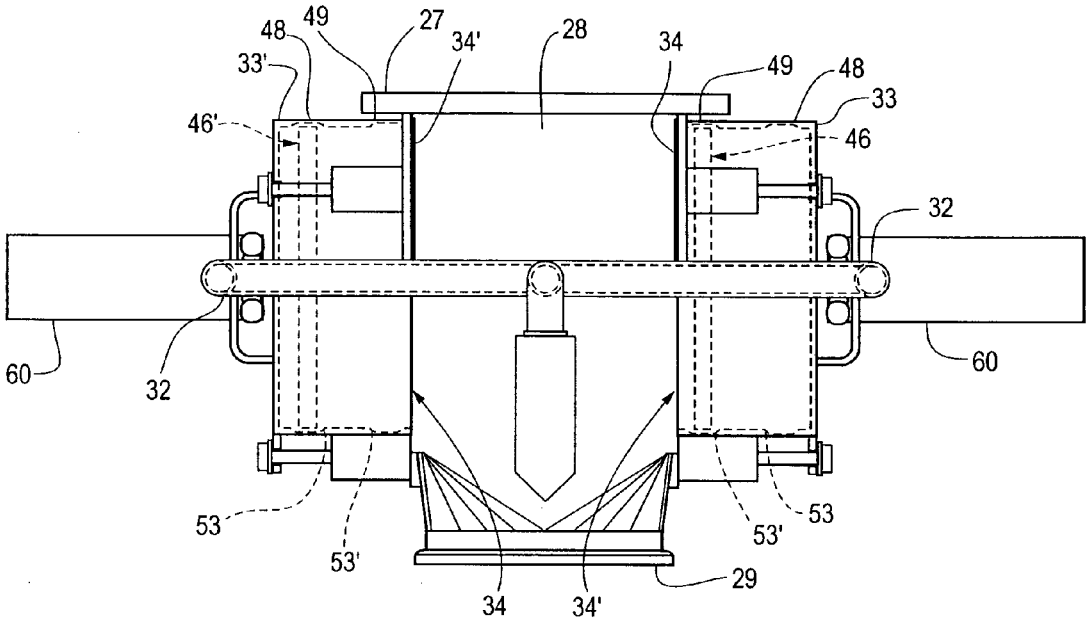

Another embodiment of a backpurge system and method of this invention is shown in FIGS. 3A and 3B. In FIGS. 3A and 3B, a piston 46 or 46' is located in each filter housing 33 and 33' associated with backpurge chamber 28. Each filter housing 33 includes an actuator 60 attached to a filter housing 33 and associated with piston 46. Actuator 60 facilitates the movement of piston 46 from a first position 48 to a second position 49 and then back to the first position 48 within filter housing 33.

In order to backpurge first filter 34 or second filter 34', one or both pistons 46 and 46' are actuated using actuator 60 (preferably a pneumatic cylinder) thereby causing piston 46 and/or 46' to move from first position 48 in filter housing 33 towards filter 34 until piston 46 reaches second position 49 in filter housing 33 thereby creating a sufficient backpressure on filter 34 to purge fines from filter 34 and directing the purged fines into outlet 29 of backflow chamber 28.

Filter housings 33 and 33' include recess 53 and 53' associated with first piston position 48 and second piston position 49 respectively. When piston 46 or 46' are associated with recesses 53 or 53', air can flow around pistons 46 and/or 46' thereby allowing the vacuum system to remove gases from backpurge chamber 28 through filters 34 and 34'. It is preferred that in all locations in the filter housing between piston position 48 and 49, that gases cannot easily bypass pistons 46 or 46'.

The process described above is reversed in order to move pistons 46 or 46' into a purge position. Pistons 46 and 46' may be operated individually or simultaneously. It is preferred that pistons 46 and 46' are operated simultaneously such that one piston, 46 for example, is moving towards a filter 34 (from first position 48 to second position 49) in order to purge the filter of fines while the opposing piston 46' is moving away from filter 46' (from second position 49 into first position 48). In this manner, this pressure of the backpurge system remains balanced during the purging process.

Spool piece 36 and pistons 46 and 46' are preferably actuated quickly. In a preferred embodiment, the piston or spool piece travels from a first position to a second position in five seconds or less and preferably in one second or less. By moving the spool piece or pistons quickly, the enclosed system pressure is not affected by the purge process.

The backpurge systems of this invention may be operated at any time that is necessary to purge filters of undesirable find. Thus, the backpurge system can be operated when the pressure differential across a filter drops to a certain level. Alternatively, the backpurge system may be operated whenever product container 50 is changed out and/or it may be operated routinely at a specific time such as every 12 hours. An important feature of the present invention is that the backpurge system can be operated while the associated process is ongoing.

The embodiments of this invention disclosed above are preferred embodiments. The description of the preferred embodiments is not intended to limit the scope of the application claims in any manner.

What is claimed is:

1. A backpurge system comprising:

a backpurge chamber including a plurality of walls forming an enclosure having an inlet and an outlet;

an opening in at least one wall of the backpurge chamber;

a filter housing associated with the opening in the at least one wall of the backpurge chamber;

a filter located in the opening;

a conduit having a first end associated with the filter housing and a second end associated with a vacuum source; and a backpurge piston associated with the filter housing wherein the backpurge piston is located in the filter housing.

2. The backpurge system of claim 1 wherein the backpurge chamber includes a first opening in a first backpurge chamber wall, a second opening in a second backpurge chamber wall, a first filter housing associated with the first opening and a second filter housing associated with the second opening.

3. The backpurge system of claim 2 wherein each filter housing includes a conduit uniting the filter housing with the vacuum source.

4. The backpurge system of claim 1 wherein the backpurge piston further comprises:

i. a filter housing including a first poiston and a second piston position;

ii. a piston located in the filter housing; and iii. a actuator associated with the backpurge systems and connected to the piston, the actuator being capable of moving the piston from the first piston position to the second piston position.

5. The backpurge system of claim 4 including a first recess in the filter housing wall at the first piston position and a recess in the filter housing wall at the second piston position.

6. The backpurge system of claim 1 wherein the backpurge piston is external to the filter housing.

7. The backpurge system of claim 6 wherein the backpurge piston further comprises:

i. a bypass spool chamber;

ii. a spool piece located in the bypass spool chamber;

iii. a conduit passing between the filter housing and the bypass spool chamber; and iv. an spool piece actuator.

8. The backpurge system of claim 7 wherein the spool piece actuator is selected from a manual actuator, a mechanical actuator, or a pneumatic actuator.

9. The backpurge system of claim 7 wherein the backpurge piston is associated with a vacuum source.

10. A material processing mill comprising:

a feed section having an outlet;

a mill chamber having an inlet associated with the feed section outlet and an outlet;

a backpurge chamber having an inlet associated with the mill chamber outlet, an outlet, and a plurality of walls, the backpurge chamber further comprising;

(i) an opening in at least one wall of the backpurge chamber;

(ii) a filter housing associated with the at least one wall opening;

(iii) a filter located in the opening in the at least one wall of the backpurge chamber;

(iv) a conduit having a first end associated with the filter housing and a second end associated with a vacuum source; and (v) and a back-purge piston associated with the filter housing; and a product container associated with the backpurge chamber outlet.

11. The material processing mill of claim 10 wherein the backpurge chamber includes a first opening in a first backpurge chamber wall, a second opening in a second backpurge chamber wall, a first filter housing associated with the first opening and a second filter housing associated with the second opening.

12. The material processing mill of claim 11 wherein each filter housing includes a conduit uniting the filter housing with the vacuum source.

13. The material processing mill of claim 10 wherein the backpurge piston is located in the filter housing.

14. The material processing mill of claim 13 wherein the backpurge piston further comprises:

i. a filter housing including a first piston position and a second piston position;

ii. a piston located in the filter housing; and iii. a actuator associated with the backpurge systems and connected to the piston, the actuator being capable of moving the piston from the first piston position to the second piston position.

15. The material processing mill of claim 14 including a first recess in the filter housing wall at the first piston position and a recess in the filter housing wall at the second piston position.

16. The material processing mill of claim 10 wherein the backpurge piston is external to the filter housing.

17. The material processing mill of claim 16 wherein the backpurge piston further comprises:

i. a bypass spool chamber;

ii. a spool piece located in the bypass spool chamber;

iii. a conduit passing between the filter housing and the bypass spool chamber; and iv. an spool piece actuator.

18. The material processing mill of claim 17 wherein the spool piece actuator is selected from a manual actuator, a mechanical actuator, or a pneumatic actuator.

19. The material processing mill of claim 17 wherein the backpurge piston is associated with a vacuum source.

* * * * *